United States Patent [19]

Kuroda

[11] 4,060,185

[45] Nov. 29, 1977

[54] BAND FOR WRIST-WATCH

[75] Inventor: Yoshiyuki Kuroda, Tokyo, Japan

[73] Assignees: Citizen Watch Co., Ltd.; Sunarrow Koski, Co., Ltd., both of Tokyo, Japan

[21] Appl. No.: 625,477

[22] Filed: Oct. 24, 1975

[30] Foreign Application Priority Data

Oct. 25, 1974 Japan ..... 49-123184

[51] Int. Cl.[2] ..... A44C 5/12

[52] U.S. Cl. ..... 224/4 F; 63/11; 224/4 K; 224/28 W

[58] Field of Search ..... 224/4 A, 4 C, 4 D, 4 E, 224/4 F, 4 J, 4 K, 28 R, 28 B, 28 C, 28 W, 4 B; 24/265 WS, 3 A, 73 WW; 63/11, 3; 58/105; 248/114

[56] References Cited

U.S. PATENT DOCUMENTS

| | | | |
|---|---|---|---|
| 1,752,128 | 3/1930 | Vetter | 24/73 WW X |
| 2,189,096 | 2/1940 | Alonge | 224/4 F |
| 2,219,277 | 10/1940 | Kaufmann | 224/4 J |
| 2,538,265 | 1/1951 | Paston | 224/4 D |
| 2,692,070 | 10/1954 | Kammer | 224/4 F |
| 2,903,172 | 9/1959 | Carter | 224/28 B |
| 3,149,452 | 9/1964 | Smith | 58/105 |
| 3,610,488 | 10/1971 | Tracy | 224/4 D X |
| 3,797,716 | 3/1974 | Mochizuki | 224/4 D |
| 3,844,458 | 10/1974 | Lanvin | 224/28 W |
| 3,968,643 | 7/1976 | Curtil | 224/4 D X |

FOREIGN PATENT DOCUMENTS

| | | | |
|---|---|---|---|
| 1,192,064 | 10/1959 | France | 224/4 D |
| 561,949 | 2/1923 | France | 63/3 |
| 70,941 | 11/1915 | Switzerland | 224/4 F |
| 368,650 | 5/1963 | Switzerland | 63/3 |

*Primary Examiner*—Robert J. Spar
*Assistant Examiner*—Winston H. Douglas
*Attorney, Agent, or Firm*—Eyre, Mann, Lucas & Just

[57] ABSTRACT

In a band for a wrist-watch comprising a thin elastic metal plate with a resilient material being backed up integrally therewith, a band for a wrist watch, in which it is free in bending along the arm without feeling any resistance when it is attached about the arm, further it has holes of fixing said watch in the middle or somewhat leftward or rightward position from the center, and still further the above-mentioned resilient material on the rearside of said metal plate will protrude a litte outward from its both side ends to prevent the human body from being injured due to both sides of said thin elastic metal plate.

7 Claims, 10 Drawing Figures

BAND FOR WRIST-WATCH

BACKGROUND OF THE INVENTION

For bands for wrist-watches, so-called chain bands connecting a lot of metal pieces in a chain style, bands made of leather, and net-style bands forming fine metal wires in a net style are known in the prior art and widely prevailing, all of which have, however, their own good points and drawbacks respectively.

More specifically, leather bands are light in weight and free in bending as compared with metal ones, but they are of such defects that they cannot stand for an extended period of time due to its weakness in material caused by age-brittleness, and further fastening metal pieces in use for leather bands will be required for ones which would not damage such leather, thus making it difficult to obtain such satisfactory metal pieces.

Then, metal bands for wrist-watches have been manufactured into a various type of constructions through complicated work, on which various kinds of platings such as gold, silver, chromium, etc. are performed, thus providing a various type and appearance of bands on the market. Such metal bands are much superior in endurance to leather ones, obtainable for high-grade feeding, and also obtainable for ones enough to match to any watch, so that such bands are widely in use. On the other hand, some of such metal bands can expand and contract their lengths, but with no elasticity, and force them to feel coldness for the human body in the cold season, therefore they have such defect that the contact feeding thereof when in use is not good.

For bands for wrist-watches are required such requirements that they will make watches more attractive, play a roll as ornaments, and be easy to use and further have a long endurability.

A band for a wrist watch in accordance with the present invention is to provide a band which can meet to each requirement mentioned above, has good touch due to a rearside resilient material and has many features that have never been provided with in bands for wrist-watches well known in the prior art.

SUMMARY OF THE INVENTION

A band for a wrist-watch in accordance with the present invention comprises a thin elastic metal plate on the surface with a resilient material being backed up integrally therewith. An object of an embodiment according to the present invention is that a band can be constructed as for a wrist-watch by virtue of the fact that on the main part thereof are provided holes of fixing a wrist-watch, about which on both ends fastening metal pieces are fitted, thus permitting it to be mounted in a bending form about the arm. Another object of an embodiment according to the present invenion is that a bending along the shape of the arm can be formed due to an elastic metal plate being made of a thin plate, wherein in case of attaching it on the arm no resistance is felt, and it can easily be attached on the arm and yet it can be attached thereon naturally and without force. Still further object of an embodiment according to the present invention is that no cold feeling peculiar to metal is felt when attaching it, no uncomfort is felt in the cold climate and further a proper gap between the arm and a band it is mounted on the arm can be obtained by the combination of elasticity of a metal plate and resiliency of a resilient material, thus resulting in eliminating the drawbacks of sweating. Still further object of an embodiment of the present invention lies in perfectly preventing from the possibility of injuring the human body due to both side ends of a thin wall elastic metal plate being in contact with the skin and, as a result, being cut off, by backing up a resilient material piece so as to protrude a little wider along said both side ends. Still further object of an embodiment according to the present invention is that, when stainless steel is used for such thin elastic metal plate, beautiful luster can be obtained only by grinding process, which is not oxidized and maintains beautiful luster semi-permanently, so a watch itself becomes more attractive, and, additionally, the number of parts is small and a watch itself becomes cheaper by saving high wages in machining and assembling processes, thus making it possible to provide popular bands. Still further object of an embodiment according to the present invention is that a construction of a mounting portion for mounting a base-frame with a wrist-watch being fitted thereon is prepared by the use of a thin surface metal plate at said mounting portion or rearside resilient material in the event of forming a mounting hole for said wrist-watch in the center of the band proper, so that no other part for mounting the above-mentioned base-frame is required. As in the foregoing, an embodiment in accordance with the present invention has such many features as to provide bands for wrist-watches having the above-mentioned many advantages in a large quantity and cheaply.

DESCRIPTION OF THE PREFERRED EMBODIMENT

An embodiment in accordance with the present invention is intended to provide such a band for a wrist-watch that it is constituted with a thin metal plate on the surface backed up with a resilient material on the rearside, which can be bent so as to conform with an arm of any person's and yet, even when repeating such bending motion, it can sustain its elastic property, and further it has beautiful luster and, in addition it can utilize such characteristic of said metal plate that any pattern can be formed on its surface, and, on the other hand, elasticity of said metal plate is reinforced by a resilient material intimately backed up on the rearside, no effect of coldness and heat due to the season on the skin being eliminated when in use, such resilient material having different elasticity from that of metal being jointly used, and further it is formed in such a manner that a watch-mounting hole and a base-frame of a watch can be provided therein, and still further it will play a full roll as ornaments with beautifulness that the conventional watch bands have never been provided. Thus, an embodiment in accordance with the present invention is to provide bands for wrist-watches having a lot of good points as bands for wrist-watches, which are excellent in many respects such as outside appearance, feeling in use as well as ornamental rolls.

Figure 1:
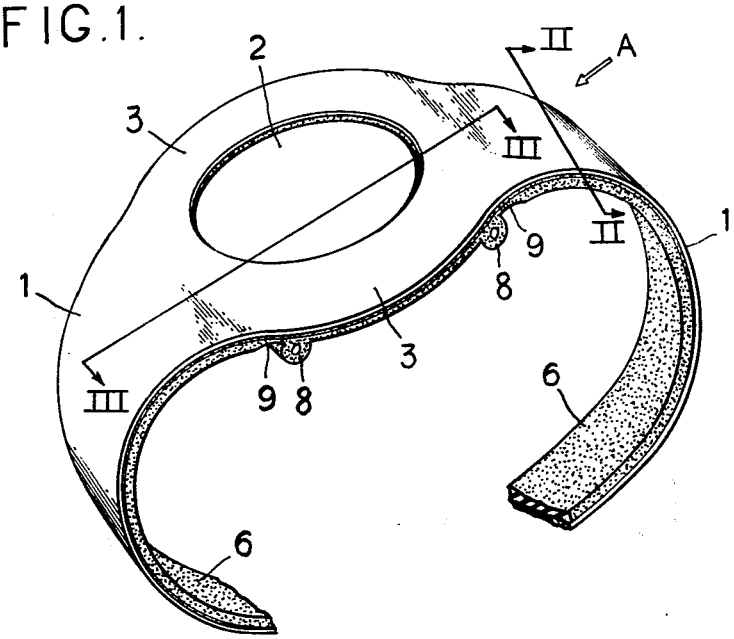
FIG. 1 is a perspective view of a part of a band for a wrist-watch in accordance with the present invention.
Figure 3:
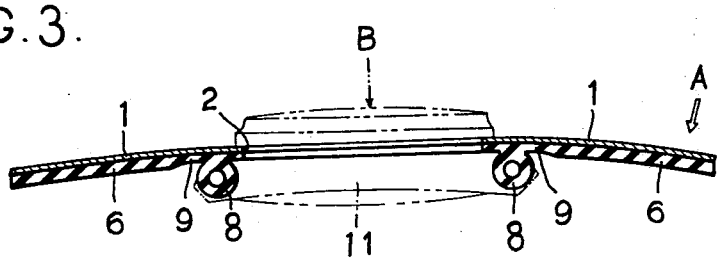
FIG. 3 is a longitudinal sectional side elevation view of an embodiment along III—III in FIG. 1.
Figure 4:
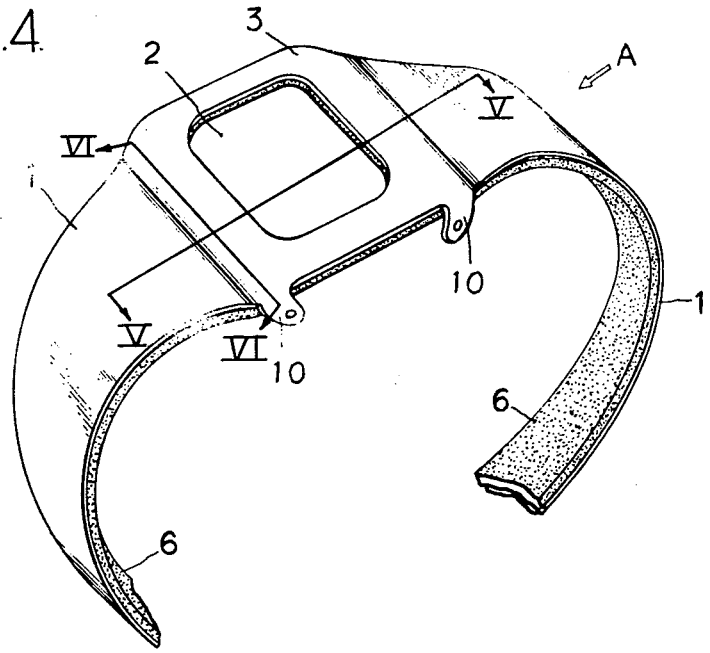
FIG. 4 is a perspective view of a modification of a hole for mounting a watch on a band for wrist-watch shown in FIG. 1.
Figure 5:
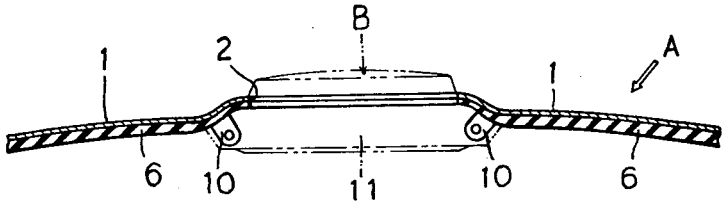
FIG. 5 is a longitudinal sectional elevation view of an embodiment along V—V in FIG. 4.
Figure 6:
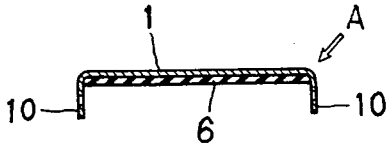
FIG. 6 is a longitudinal section view of an embodiment taken on line VI—VI in FIG. 5.
Figure 7:
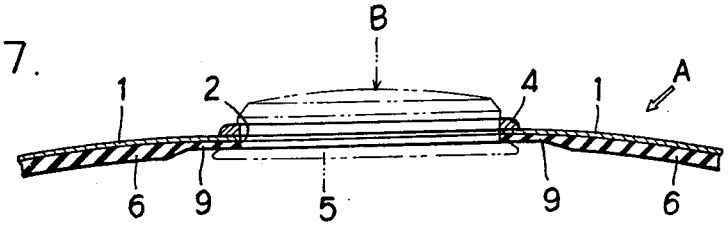
FIG. 7 is another embodiment of a band for a wrist-watch, and, more specifically, a longitudinal sectional side elevation view of an embodiment having no mounting portions on a base-frame at a watch-mounting portion in the center of said band as shown in FIGS. 1, 3 and 5.

Referring now to an embodiment according to the present invention in more detail referring to the appended drawings, and in addition, to features and novelties of bands for wrist-watches in accordance with the present invention, in a band for a wrist-watch represented by the symbol A, its surface is made of a thin elastic metal plate 1. When this thin elastic metal plate is formed with a thin metal plate having beautiful luster produced only by grinding process without plating, for instance, stainless steel, then it will produce a beautiful appearance different from that of a plated band, in other words, it will have an incomparable appearance with plating of a watch, thus enabling a user's wrist-watch to be more attractive. A mounting hole 2 for mounting a wrist-watch itself B (which is shown with dotted line in FIGS. 3, 5 and 7) or a base frame (see FIG. 5) of a wrist-watch fitted therein is opened principally in the center or in a little leftward or rightward position of a band proper A. A band proper for a wrist-watch is adapted to have enough length to be in intimate contact with the surrounding surface of each person's arm over its entire surface, and since its thickness differs a little according to each person, such band will be formed into about three kinds of lengths of long, medium and short ones, nevertheless a little adjustment of its length can be made by fastening metal pieces C to be fitted on both ends of a band proper. The above-mentioned mounting hole 2 for mounting a wrist-watch B shall be opened according to types such as size and shape of a wrist-watch, i.e. square or rectangle, and other irregularities. For instance, FIG. 1 shows a circular hole, FIG. 4 shows a mounting hole 2 conforming with the most common square watches, and for other irregular watches shall be provided mounting holes 2 conforming therewith. Further, a section of a mounting hole 2 for mounting a wrist-watch B is formed, as shown in FIGS. 1 and 4, a little wider 3 than a width of the other part of a band proper A to be attached on the arm, so as to permit said mounting hole 2 to be opened widely. In order to mount a wrist-watch B in a mounting hole 2, it is performed by mounting a glass-mounting ring 4 on the surface of the band and a rear cap 5 from the rear side. In case a wrist-watch B is fitted in a base-frame 11, this base-frame 11 will be mounted on a mounting portion 8. (See FIGS. 3 and 5).

On the rear side of said thin plastic metal plate 1 is securely backed a resilient material 6, which is made of a thin rubber or synthetic resin plate, wherein a rubber plate is heat-welded, while synthetic resin is securely backed up integrally with said metal plate by means of bonding agent. Said resilient material 6 shall be made of good, resilient and flexible material so as to accommodate itself with bending on the surface of the thin elastic metal plate 1.

Said elastic metal plate 1 shall be elastic and be made of beautiful glossy metal produced by grinding, such as stainless steel. This stainless steel plate will produce beautiful luster by grinding process and is rust-proof, so that it can maintain beautiful luster for a long period of time, and where its luster is lost in use for a long time, such luster can be reproduced by regrinding. A band can be formed by punching such plate, wherein said mounting hole 2 will also be punched out simultaneously. In some cases, such luster will be frosted to conform with plating of a watch on purpose.

Figure 2:
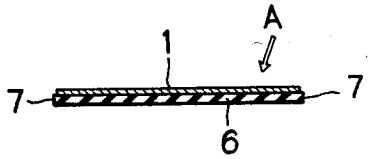
FIG. 2 is a longitudinal section view of an embodiment according to the present invention taken on line II—II of FIG. 1.

A resilient plate 6 secured to the rearside of a band is made of rubber plate or synthetic resin plate, which will also be punched by dies a little wider than a width of the afore-mentioned elastic metal plate 1, this resilient plate being adapted to prevent the human body from being hurt with both side ends of a said thin elastic metal plate 1 by virtue of protruding the resilient plate 6 a little from both side ends of the metal plate 1 when the former 6 is backed up with the rearside of the latter 1. (See FIG. 2).

In case of said resilient plate 6 being backed up with a rubber plate, a raw rubber plate is bonded with bonding agent, vulcanizing it by heat after drying, then securing it by pressing. A synthetic resin plate shall be secured thereto by the use of strong bonding agent. Primarily, a rubber plate will be used.

Referring now to a case when a wrist-watch B is mounted on a base-frame 11 and this frame is then mounted on a band, the frame will be mounted thereon by forming a mounting portion on both a thin elastic metal plate 1 on the surface and a resilient plate 6 on the rear side. FIG. 1 shows a case when a mounting portion 8 has been formed on a resilient material 6. It goes without saying that such mounting portion shall be formed by pressing process. In this case, the mounting portions 8 will be formed at four locations around the mounting hole 2 or in a tubular form in the center thereof and further thin wall sections 9 will be formed on the opposite of the mounting hole 2 of a band so as to allow a wrist watch to make a little movement. A case when mounting portions of a base-frame are formed on a thin elastic metal plate 1 is given in FIG. 4, wherein said mounting portions are formed at each two locations on both sides, totally four locations, of a mounting hole 2 of a thin elastic metal plate 1 by protruding mounting lugs 10 from a band itself, which will then be bent downward. In such a case, when a base-frame is provided with recessed portions which can often be seen in conventional wrist-watches, mounting portions 8 of a resilient material 6 will be formed in comformity with those recessed portions, into which said mounting portions will be fitted, then fixed with pins to be inserted into the mounting lugs 1 mentioned above.

Figure 8:
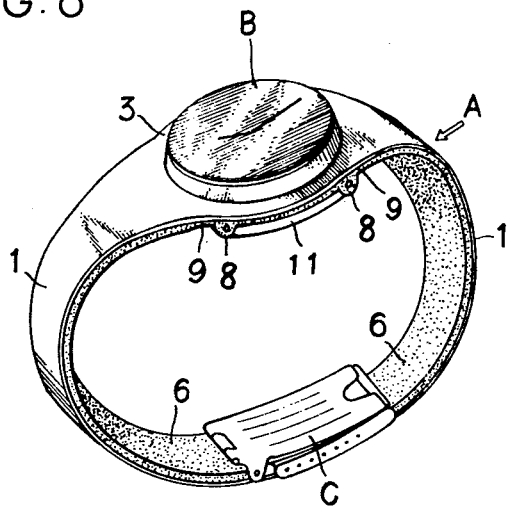
FIG. 8 is a perspective view of the entire band in FIG. 1 provided with fastening metal pieces on both ends thereof and also with a wrist-watch in its center.
Figure 9:
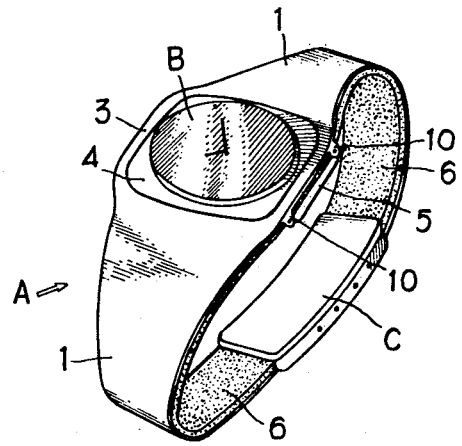
FIG. 9 is a perspective view of the entire band in FIG. 4 provided with fastening metal pieces on both ends thereof as well as with a wrist-watch.
Figure 10:
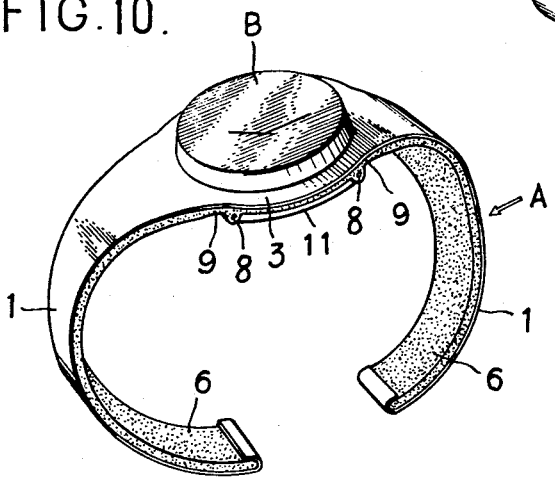
FIG. 10 is a longitudinal sectional side elevation view of still another embodiment having no fastening metal pieces on both ends of a band.

In the drawings, FIG. 8 shows a condition that a wrist-watch is attached to a band proper A in FIG. 1, and FIG. 9 shows a condition that a wrist-watch is attached to a band proper A shown in FIG. 4, both of which show conditions that fastening metal pieces C are fitted with the bands respectively. These fastening metal pieces C are ones which can be opened and closed as well-known in the prior art, and those are of such construction as to be expandable and contractable, thereby making it possible to automatically adjust a length of a band proper A. FIG. 10 is another embodiment in accordance with the present invention, in which a band proper A is bent in almost semi-circular form on its both ends without the use of fastening metal pieces C on a band proper A, and said band proper A utilizes a spring-elasticity generated by its bending.

As in the foregoing, an embodiment in accordance with the present invention has such excellent features that can never been seen in conventional bands, more specifically, it can provide a novel band for wrist watch, which not only can attain its many objects set forth in the above-mentioned specification, but also it is constructed with a smaller number of components, no assembly of a band proper is needed at all, its elastic force is adequate for the arm for the reason of its elastic metal plate being made of a thin plate, additionally, the advantages of both above properties and resiliency of a resilient material on the rearside being combined dexterously and further it is designed to operate both elasticity and spring action in cooperation with each other.

What is claimed is:

1. A band for a wrist-watch adapted to fit the arm of a user comprising a thin elastic metal plate having front and rear surfaces and first and second ends, a mounting hole through said metal plate adapted for mounting said wrist-watch behind said mounting hole with the back of the watch adjacent to said rear surface and the face of said watch protruding partly through said mounting hole, the ends of said metal plate forming a wrist encircling portion for the arm, and the metal plate being one piece, resilient material bonded to the rear surface of said wrist encircling portion, and said resilient material being wider than said wrist encircling portion whereby said resilient material protrudes outward beyond the side edges of said wrist encircling portion, and the front surface of said metal plate being exposed.

2. In a band for a wrist watch set forth in claim 1, in which in a wrist watch is of the type which is mounted on a base-frame, the improvement comprising means for mounting the base-frame behind said mounting hole.

3. In a band for a wrist-watch set forth in claim 2, said means for mounting being formed in said resilient material.

4. A band for a wrist-watch set forth in claim 3, further comprising the resilient material between said base frame and said metal plate thinner than the resilient material on said wrist encircling portion.

5. In a band for a wrist-watch set forth in claim 2, wherein said means for mounting comprises mounting lugs formed at the perimeter of said metal plate.

6. In a band for a wrist-watch set forth in claim 1, wherein said metal plate is thin stainless steel plate having beautiful luster by grinding process.

7. A band for a wrist watch set forth in claim 1 further comprising a fastening metal piece adapted to adjusting the length of the band.

* * * * *